US007322335B2

(12) United States Patent
Suzuki et al.

(10) Patent No.: US 7,322,335 B2
(45) Date of Patent: Jan. 29, 2008

(54) OIL PAN STRUCTURE

(75) Inventors: Yoshinori Suzuki, Gamagoori (JP); Koichiro Komatsu, Toyota (JP); Hisayoshi Kato, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/299,899

(22) Filed: Dec. 13, 2005

(65) Prior Publication Data

US 2006/0130801 A1 Jun. 22, 2006

(30) Foreign Application Priority Data

Dec. 20, 2004 (JP) ..... 2004-368504

(51) Int. Cl.
*F02F 7/00* (2006.01)

(52) U.S. Cl. ..... 123/195 C; 184/1.5

(58) Field of Classification Search ..... 123/196 R, 123/195 C; 184/1.5
See application file for complete search history.

(56) References Cited

U.S. PATENT DOCUMENTS 3,033,311 A * 5/1962 Edgar et al. ..... 184/1.5
5,074,380 A 12/1991 Bedi et al.

FOREIGN PATENT DOCUMENTS

| | | |
|---|---|---|
| DE | 41 22 288 C2 | 12/2000 |
| GB | 2 147 953 A | 5/1985 |
| JP | A 7-305619 | 11/1995 |
| JP | A 11-62543 | 3/1999 |
| JP | A 11-270324 | 10/1999 |
| JP | A 2002-221017 | 8/2002 |

* cited by examiner

*Primary Examiner*—Noah P. Kamen
(74) *Attorney, Agent, or Firm*—Kenyon & Kenyon LLP

(57) ABSTRACT

An oil pan structure includes a tubular level-gauge guide into which an oil level-gauge that measures the amount of oil stored in the oil pan is inserted. The oil pan structure further includes a nozzle guide that guides the end of a nozzle of an oil changer, which is inserted into the level-gauge-guide when the oil in the oil pan is replaced with new oil, to a position near the deepest portion of the reservoir portion.

8 Claims, 9 Drawing Sheets

OIL PAN STRUCTURE

INCORPORATION BY REFERENCE

The disclosure of Japanese Patent Application No. 2004-368504 filed on Dec. 20, 2004 including the specification, drawings and abstract is incorporated herein by reference in its entirety.

BACKGROUND OF THE INVENTION

1. Field of the Invention

The invention relates to an oil pan structure.

2. Description of the Related Art

Usually, an oil pan is provided below the cylinder-block of an internal combustion engine used in, for example, a vehicle. This oil is used, for example, to cool, and lubricate the internal combustion engine. Such an oil pan is provided with a tubular level-gauge guide where one end opens into the reservoir portion of the oil pan, in which oil is stored. Generally, an oil level-gauge inserted in this level-gauge guide measures the amount of oil stored in the reservoir portion.

When the oil in oil pan needs to be replaced with new oil, an oil changer, instead of the oil level-gauge, may be inserted into the level-gauge guide to draw the used oil up from the reservoir portion. Ideally, very little or no residual amount of the used oil remains in the reservoir portion after removal of the used oil.

However, because it is difficult to accurately determine whether the end of the oil changer is guided to the deepest portion of the reservoir portion when the oil changer draws up the oil in the reservoir portion, the following problem may arise. If the end of the oil changer is not guided to the deepest portion, some oil remains in the deepest portion even after draw-up of the used oil ends, because the oil changer cannot efficiently draw up the oil in the reservoir portion.

The following approach to address such a problem is known, for example, as described in Japanese Patent Application Publication No. JP-A-2002-221017. A cylindrical body, which connects the lower end of the level-gauge guide to the bottom surface of the oil pan, is arranged in the reservoir portion of the oil pan. As a result, a gas-tight seal is formed between the lower end of the level-gauge guide and the bottom surface of the oil pan. In addition, a passage-forming member is attached to the bottom surface of the oil pan. This passage-forming member forms a passage that connects the bottom surface of the oil pan, which contacts the lower end of the cylindrical body, to the deepest portion of the reservoir portion. Then, two through-holes are formed. One through-hole provides communication between the space in the cylindrical body and the passage formed by the passage-forming member. The other through-hole provides communication between the passage and the deepest portion of the reservoir portion. With these two through-holes, the oil can flow between the level-gauge guide and the deepest portion of the reservoir portion. Thus, the oil changer inserted in the level-gauge guide can smoothly draw the oil up from the deepest portion of the reservoir portion through the passage formed by the passage-forming member and the cylindrical body.

According to the described approach, however, additional components are required. For example, the cylindrical body needs to be arranged in the oil pan, and the passage-forming member needs to be attached to the bottom surface of the oil pan. This increases the number of components, and, therefore, complicates the arrangement of components. In addition, because the through-holes are required to form the passage through which the oil changer draws up the oil, the structure of the oil pan becomes considerably complicated.

SUMMARY OF THE INVENTION

It is an object of the invention to provide a simple oil pan structure that enables an oil changer to smoothly draw oil up from the deepest portion of a reservoir portion without increasing the number of components.

An oil pan structure according to a first aspect of the invention includes a tubular member that provides communication between the reservoir portion and an outside of the oil pan, and is arranged such that one end of the tubular member opens into the reservoir portion. In addition, the oil pan structure includes a nozzle guide that guides an end of a nozzle of an oil changer, which is inserted into the tubular member and which replaces oil in the reservoir portion with new oil, to a position near a deepest portion of the reservoir portion.

According to the first aspect, the nozzle guide guides the end of the nozzle of the oil changer to the position near the deepest portion of the reservoir portion of the oil pan. As a result, the end of the nozzle is reliably guided to the deepest portion of the reservoir portion, and the oil in the reservoir portion can be more efficiently drawn up from the deepest portion. In addition, it is possible to minimize the amount of oil that remains in the deepest portion of the reservoir portion even after draw-up of the used oil ends, without employing a complicated oil pan structure.

In the first aspect, a stopper may be provided. This stopper sets the end of the nozzle of the oil changer at the position near the deepest portion of the reservoir portion. The end of the nozzle of the oil changer is reliably positioned near the deepest portion of the reservoir portion by the stopper. This prevents the end of the nozzle of the oil changer from going beyond the deepest portion, thereby deviating upward from the deepest portion. It is, therefore, possible to more efficiently draw the oil up from the deepest portion of the reservoir portion, and more effectively minimize the amount of oil that remains in the reservoir portion even after draw-up of the used oil ends.

In the first aspect, a guide portion, which guides the end of the nozzle of the oil changer that has been guided into the reservoir portion to the nozzle guide, may be provided. The guide portion may be provided above the position at which the bottom surface of the oil pan intersects with the virtual guide line. This virtual guide line corresponds to the path that the nozzle of the oil changer would continue along after being inserted in the level-gauge guide and guided into the reservoir portion in the absence of any obstructions in the path.

Provision of such a guide portion prevents the end of the nozzle of the oil changer from (a) coming into contact with the bottom-wall surface of the oil pan, thereby becoming stuck at the bottom-wall surface, and (b) adopting an inappropriate orientation after coming into contact with the bottom-wall surface of the oil pan. With such a structure, the end of the nozzle of the oil changer is reliably guided to the nozzle guide by the guide portion. This structure, therefore, provides greater ease in smoothly guiding the end of the nozzle of the oil changer to the position near the deepest portion of the reservoir portion.

The nozzle guide may be formed separately from the oil pan body and then attached to the oil pan body, or may be formed integrally with the oil pan body. Similarly, the stopper may be formed separately from the oil pan body and then attached to the oil pan body, or may be formed integrally with the oil pan body.

BRIEF DESCRIPTION OF THE DRAWINGS

The foregoing and further objects, features and advantages of the invention will become apparent from the following description of example embodiments with reference to the accompanying drawings, in which the same or corresponding portions are identified using the same reference numerals and wherein.

DETAILED DESCRIPTION OF THE EXAMPLE EMBODIMENTS

Hereafter, an embodiment of the invention will be described with reference to accompanying drawings.

Figure 1:
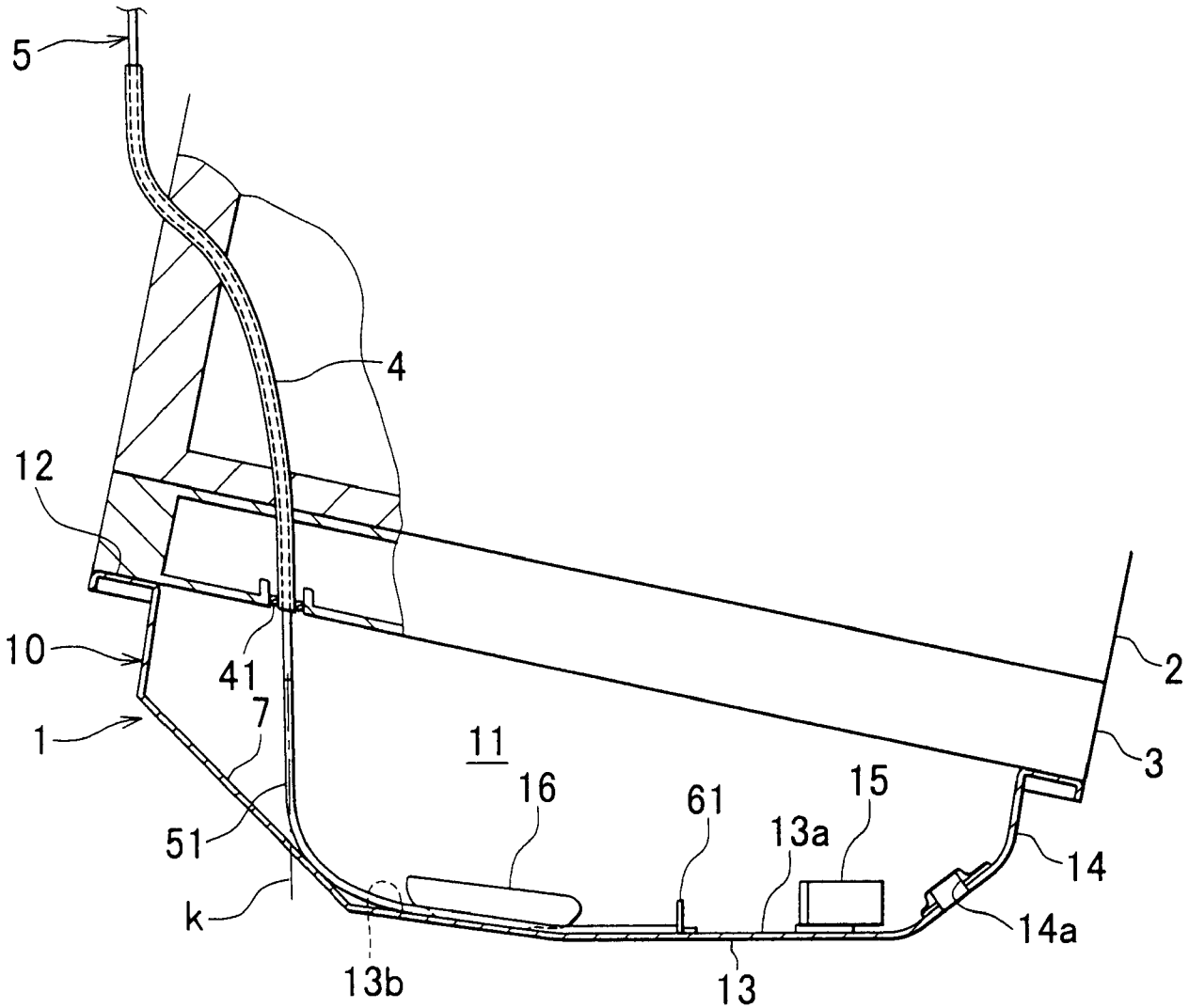
FIG. 1 illustrates the cross-sectional view of a portion near the lower portion of a cylinder-block provided with an oil pan according to an embodiment of the invention, which is taken along line I-I in FIG. 2.
Figure 2:
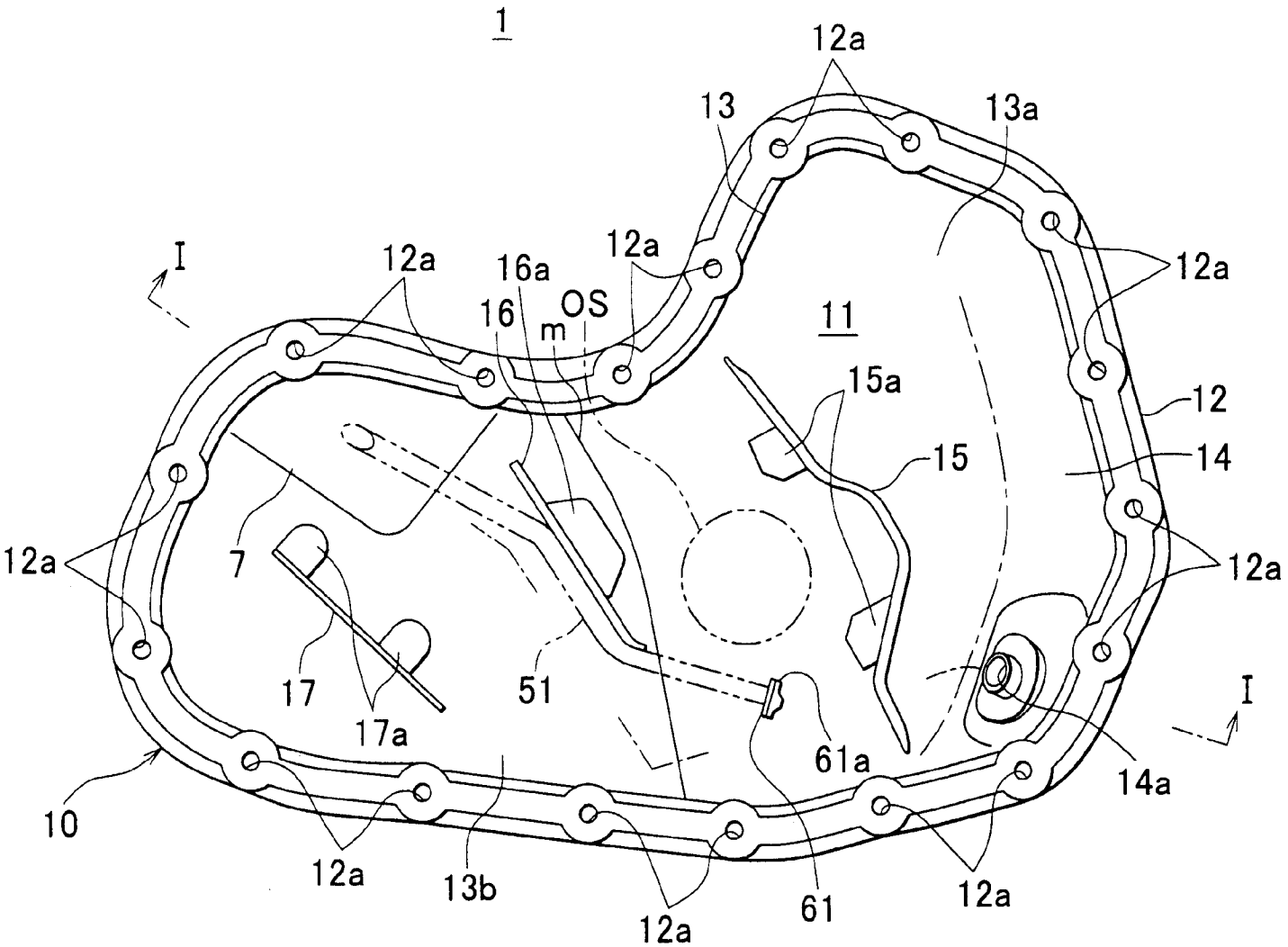
FIG. 2 illustrates the plan view of the oil pan.

FIG. 1 illustrates the cross-sectional view of the portion near the lower portion of a cylinder-block 2 provided with an oil pan 1. FIG. 2 illustrates the plan view of the oil pan 1. The oil pan 1 is attached, via an oil pan gasket (not shown), to the bottom surface of a cylinder-block-lower-case 3 attached to the bottom surface of the cylinder-block 2 of an internal combustion engine. In this case, the internal combustion engine is mounted in a vehicle body at an incline toward the front of the vehicle. Similarly, the cylinder-block 2 and the cylinder-block-lower-case 3 are at an incline toward the front of the vehicle.

Figure 3:
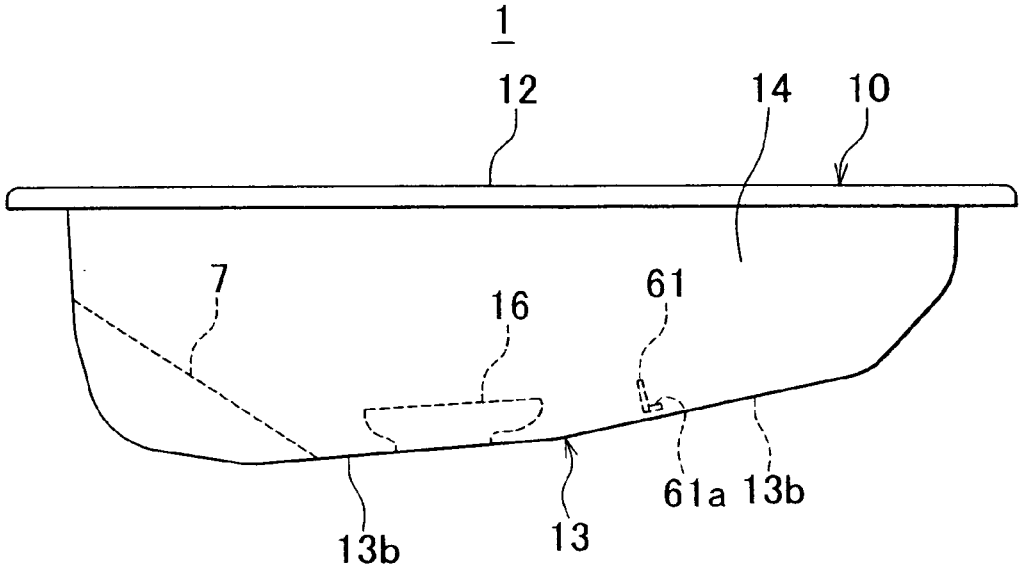
FIG. 3 illustrates the side view of the oil pan that is not attached to the cylinder-block, viewed from the side of a vehicle body.
Figure 4:
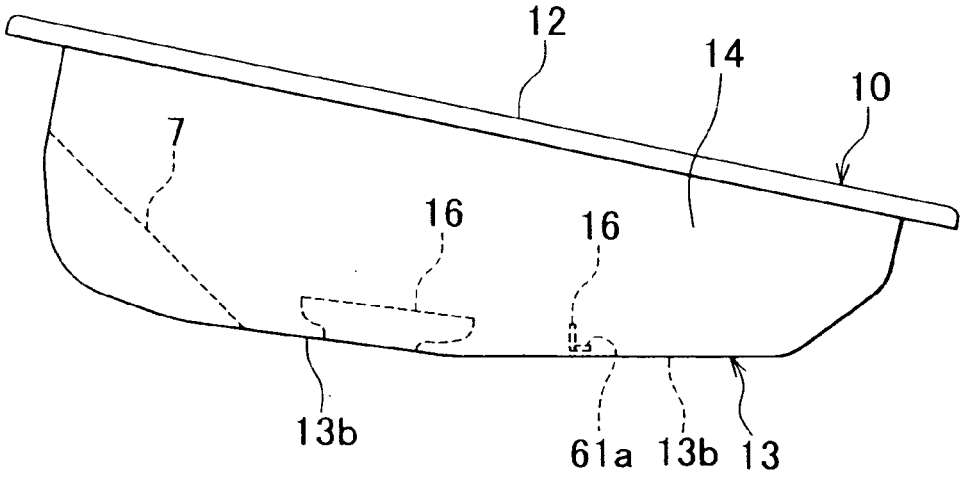
FIG. 4 illustrates the side view of the oil pan that is attached to the cylinder-block, viewed from the side of the vehicle body.

As shown in FIGS. 3 and 4, the oil pan 1 has a reservoir portion 11 in which oil can be stored when an oil pan body 10 is attached to the cylinder-block-lower-case 3. The oil pan body 10 may be formed, for example, by pressing a steel plate into the appropriate shape. The oil pan body 10 includes a flange portion 12, a bottom-wall portion 13, and a side-wall portion 14. The flange portion 12 faces the attachment-surface of the cylinder-block-lower-case 3 when the oil pan body 10 is attached to the cylinder-block-lower-case 3. The bottom-wall portion 13 forms the bottom surface of the oil pan 1. The side-wall portion 14 extends between the flange portion 12 and the bottom-wall portion 13.

In the flange portion 12, bolt-holes 12*a*, through which bolts (not shown) that fasten oil pan body 10 to the cylinder-block-lower-case 3 are inserted, are formed at predetermined intervals in the circumferential direction. The bottom-wall portion 13 has a forward portion 13*a* (the right-side portion of the bottom-wall portion 13 in FIGS. 1 to 4) and a rear portion 13*b* (the left-side portion of the bottom-wall portion 13 in FIGS. 1 to 4) in the longitudinal direction. The bottom-wall portion 13 is divided into the forward portion 13*a* and the rear portion 13*b* at a boundary "m" shown in FIG. 2. The forward portion 13*a* and the rear portion 13*b* are slightly angled with respect to each other toward the boundary "m". When the oil pan body 10 is attached to the cylinder-block-lower-case 3, the forward portion 13*a* is substantially parallel to the road surface. In this case, the forward portion 13*a* of the bottom-wall portion 13 becomes the deepest portion of the reservoir portion 11 when the oil pan body 10 is attached to the cylinder-block-lower-case 3.

On the bottom-wall portion 13, a first frothing-suppression plate 15, a second frothing-suppression plate 16, and a third frothing-suppression plate 17 are provided in this order from the front side of the vehicle body. The first to third frothing-suppression plates 15, 16 and 17 suppress frothing of the oil in the reservoir portion 11 that may occur for example, due to the swaying of the vehicle body when the vehicle is in motion. The first to third frothing-suppression plates 15, 16 and 17 are provided with substantially L-shaped flange pieces 15*a*, 16*a* and 17*a*, respectively. The first to third frothing-suppression plates 15, 16 and 17 are attached to the bottom-wall portion 13 of the oil pan body 10 via the flange pieces 15*a*, 16*a*, and 17*a*, respectively, by spot welding. In addition, a drain-hole 14*a*, which may be sealed by a drain-plug (not shown), is formed in the lower end portion of the side-wall portion 14 on the front side of the vehicle body. The area indicated by "OS" in FIG. 2 indicates an oil strainer through which the oil is drawn up from the deepest portion of the reservoir portion 11 (i.e., the forward portion 13*a* of the bottom-wall portion 13).

The oil pan body 10 is provided with a tubular level-gauge guide 4 where one end opens into the reservoir portion 11. The upper end of the level-gauge guide 4 protrudes upward from the lower end of the cylinder-block 2 on the rear side of the vehicle body. The level-gauge guide 4 passes through the lower end portion of the cylinder-block 2 and the cylinder-block-lower-case 3. The lower end of the level-gauge guide 4 opens into the reservoir portion 11. The lower end portion of the level-gauge guide 4 is attached to the lower end of the cylinder-block-lower-case 3 via an O-ring 41 shown in FIG. 1. As a result, a gas-tight seal is formed between the lower end portion of the level-gauge guide 4 and the lower end of the cylinder-block-lower-case 3. An oil level-gauge (not shown), which measures the amount of oil remaining in the reservoir portion 11 of the oil pan body 10, may be inserted in the level-gauge guide 4. When the oil in the reservoir portion 11 is replaced with new oil, a nozzle 51 of an oil changer 5 is inserted, instead of the oil level-gauge, into the level-gauge guide 4.

The second frothing-suppression plate 16 is arranged on the rear portion 13*b* of the bottom-wall portion 13 of the oil pan body 10. The second frothing-suppression plate also serves as a nozzle guide that guides the end of the nozzle 51 of the oil changer 5 to a position near the deepest portion (the forward portion 13*a*) of the bottom-wall portion 13 of the reservoir portion 11. The nozzle 51 of the oil changer 5 is inserted, instead of the oil level-gauge, into the level-gauge guide 4 when the oil in the reservoir portion 11 is replaced with the new oil. Also, a stopper 61 is provided on the forward portion 13*a* of the bottom-wall portion 13 of the oil pan body 10. The stopper 61 sets the end of the nozzle 51 of the oil changer 5, which is guided to the position near the deepest portion of the reservoir portion 11 by the second frothing-suppression plate 16 (nozzle guide) when the oil in the reservoir portion 11 is replaced with the new oil, at this position. The stopper 61 is provided with a substantially L-shaped flange piece 61*a*. The stopper 61 is attached to the forward portion 13*a* of the bottom-wall portion 13 of the oil pan body 10 via this flange piece 61*a* by spot welding.

In addition, the rear portion 13*b* of the bottom-wall portion 13 of the oil pan body 10 is provided with a guide portion 7. This guide portion 7 guides the end of the nozzle 51 of the oil changer 5 to the second frothing-suppression plate 16 (nozzle guide). The guide portion is provided above the position at which the rear portion 13*b* of the bottom-wall portion 13 of the oil pan 10 intersects with a virtual guide line "k". This virtual guide line "k" corresponds to the path that the nozzle 51 of the oil changer 5 would continue along after being inserted in the level-gauge guide 4 and guided into the reservoir portion 11 in the absence of any obstructions in the path. The guide portion 7 is provided integrally with the oil pan body 10. The guide portion 7 is tilted with respect to the rear portion 13*b* of the bottom-wall portion 13. In this case, the forward portion 13*a* of the bottom-wall portion 13 is substantially parallel to the road surface when the oil pan body 10 is attached to the cylinder-block-lower-case 3.

According to the embodiment, the end of the nozzle 51 of the oil changer 5 is guided to the position near the deepest portion (the forward portion 13*a*) of the bottom-wall portion 13 of the reservoir portion 11 by the second frothing-suppression plate 16. Thus, the end of the nozzle 51 of the oil changer 5 is reliably guided to the deepest portion of the reservoir portion 11. This makes it possible to efficiently draw up the oil from the deepest portion of the reservoir portion 11, and to effectively minimize the amount of oil that remains in the deepest portion of the reservoir portion 11 even after draw-up of the used oil ends.

In this case, the second frothing-suppression plate 16 guides the end of the nozzle 51 of the oil changer 5 to the position near the deepest portion of the reservoir portion 11 of the oil pan body 10. Accordingly, additional components such as a cylindrical body and a passage-forming member are not necessary, and, therefore, the arrangement of the components in the oil pan 1 does not become complicated. In addition, through-holes that enable the oil to be drawn up through the passage need not be formed. Therefore, provision of the second frothing-suppression plate 16 makes it possible to efficiently draw the oil up from the deepest portion of the reservoir portion 11 without complicating the structure of the oil pan 1.

The stopper 61 sets the end of the nozzle 51 of the oil changer 5, which is guided to the position near the deepest portion of the reservoir portion 11 by the second frothing-suppression plate 16 when the oil in the reservoir portion 11 is replaced with the new oil, at this position. Because this stopper 61 is arranged on the forward portion 13*a* of the bottom-wall portion 13 of the oil pan body 10, the end of the nozzle 51 of the oil changer 5 is reliably set at the position near the deepest portion of the reservoir portion 11 by the stopper 61. This prevents the end of the nozzle 51 of the oil changer 5 from going beyond the deepest portion, thereby deviating upward from the deepest portion of the reservoir portion 11. It is, therefore, possible to efficiently draw the oil up from the deepest portion of the reservoir portion 11, and minimize the amount of oil that remains in the deepest portion even after draw-up of the used oil ends. In addition, although an additional component, the stopper 61 that positions the end of the nozzle 51 of the oil changer 5, need to be provided, the total number of components is not increased because the second frothing-suppression plate 16 that suppress frothing of the oil also serves as the nozzle guide. As a result, the oil in the deepest portion of the reservoir portion 51 can be efficiently drawn up without complicating the structure of the oil pan 1.

In addition, the guide portion 7, which guides the end of the nozzle 51 of the oil changer 5 guided into the reservoir portion 11 to the second frothing-suppression plate 16, is provided on the rear portion 13*b* of the bottom-wall portion 13 of the oil pan body 10. Provision of the guide portion 7 prevents the end of the nozzle 51 of the oil changer 5 from (a) coming into contact with the rear portion 13*b* of the bottom-wall portion 13 of the oil pan body 10, thereby becoming stuck at the bottom-wall portion 13, and (b) adopting an inappropriate orientation after coming into contact with the rear portion 13*b* of the bottom-wall portion 13. The end of the nozzle 51 is reliably guided to the second frothing-suppression plate 16 by the guide portion 7 that directs the end of the nozzle 51 toward the second frothing-suppression plate 16. This structure, therefore, provides greater ease in smoothly guiding the end of the nozzle 51 of the oil changer 5 to the position near the deepest portion of the reservoir portion 11.

In addition, the second frothing-suppression plate 16 (nozzle guide) and the stopper 61, formed separately from the oil pan body 10, are attached to the bottom-wall portion 13 of the oil pan body 10 via the flange pieces 16*a*, and 61*a*, respectively, by spot welding. Accordingly, a nozzle guide and a stopper can be easily welded to the most suitable positions of each of the oil pan bodies having the same shape but are provided with level-gauge guides at different positions. This makes it possible to produce the base oil pan bodies 10 at low cost by pressing the metal plates into the appropriate shape using the same stamping die. This structure, therefore, enhances the cost efficiency and flexibility in production of the oil pan bodies 10.

Figure 5:
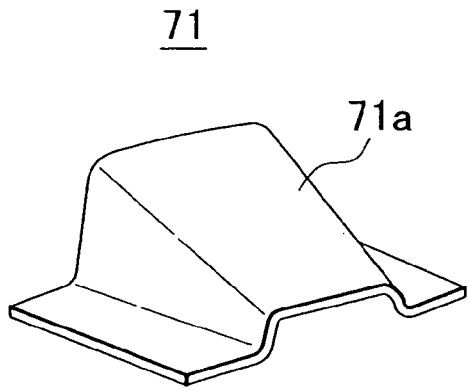
FIG. 5 illustrates the perspective view of a guide member in a modified example of the embodiment.
Figure 6:
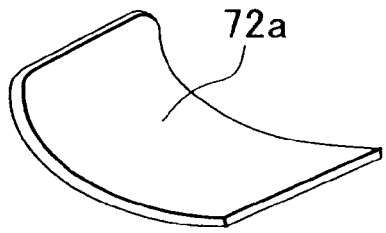
FIG. 6 illustrates the perspective view of a guide member in another modified example of the embodiment.
Figure 7:
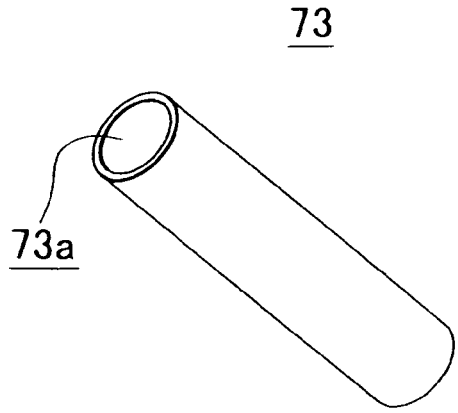
FIG. 7 illustrates the perspective view of a guide member in another modified example of the embodiment.

Note that, the invention is not limited to the above-mentioned embodiment, and the invention may be realized in various other embodiments within the scope of the invention. For example, in the above-mentioned embodiment, the guide portion 7 is provided integrally with the rear portion 13*b* of the bottom-wall portion 13 of the oil pan body 10. However, a guide member (guide portion) 71 shown in FIG. 5, a guide member (guide portion) 72 shown in FIG. 6 or a guide member (guide portion) 73 shown in FIG. 7, formed separately from the oil pan body 10, may be provided above the position at which the rear portion 13*b* of the bottom-wall portion 13 of the oil pan body 10 intersects with the virtual guide line. This virtual guide line corresponds to the path that the nozzle 51 of the oil changer 5 would continue along after being inserted in the level-gauge guide 4 and guided into the reservoir portion 11 in the absence of any obstructions in the path. The guide member 71 has a substantially convex-shaped cross-section, and has an inclined-surface 71*a* that guides the end of the nozzle 51 of the oil changer 5. The guide member 72 has a substantially arc-shaped cross-section, and has an arc surface 72*a* that curves against the bottom-wall portion 13 of the oil pan body 10 to guide the end of the nozzle 51 of the oil changer 5. The guide member 73 has a cylindrical shape, and the end of the nozzle 51 of the oil changer 5 is inserted into an inner space 73*a* to be guided. Each of the guide members 71, 72 and 73 may be formed separately from the oil pan body 10, and then attached to the oil pan body 10, for example, by spot welding.

Figure 8:
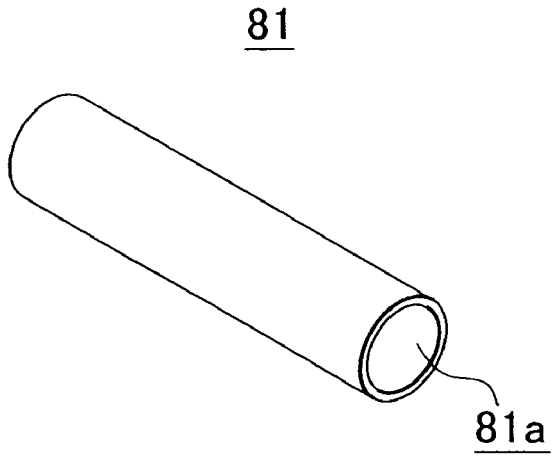
FIG. 8 illustrates the perspective view of a nozzle guide in another modified example of the embodiment.
Figure 9:
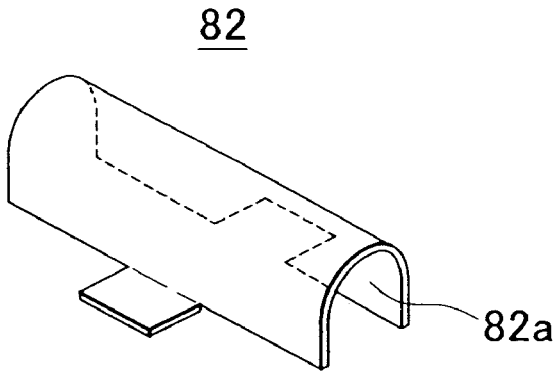
FIG. 9 illustrates the perspective view of a nozzle guide in another modified example of the embodiment.

In the above-mentioned embodiment, the second frothing-suppression plate 16 having the substantially L-shaped cross-section, which also serves as the nozzle guide, is attached to the bottom-wall portion 13 of the oil pan body 10 by welding. However, a cylindrical nozzle guide 81 shown in FIG. 8 or an arch-shaped or semi-cylindrical nozzle guide 82 shown in FIG. 9 may be provided. In the nozzle guide 81, the end of the nozzle 51 of the oil changer 5 is inserted in an inner space 81*a* to be guided to the position near the deepest portion of the reservoir portion 11 of the oil pan 1. In the nozzle guide 82, the end of the nozzle 51 of the oil changer 5 is inserted in a dome-shaped inner space 82*a* to be guided to the position near the deepest portion of the reservoir portion 11 of the oil pan 1. Each of the nozzle guides 81 and 82 may be formed separately from the oil pan body 10, and then attached to the oil pan body 10, for example, by spot welding.

In the above-mentioned embodiment, the nozzle guide and the stopper are formed separately from the oil pan body. Accordingly, the nozzle guide and the stopper can be easily welded to the most suitable positions of each of the oil pan bodies that have the same shape but are provided with level-gauge guides at different positions. This makes it possible to produce the base oil pan bodies 10 at low cost by pressing the metal plates into the appropriate shape using the same stamping die. This structure, therefore, enhances the cost efficiency and flexibility in production of the oil pan bodies 10.

Figure 10:
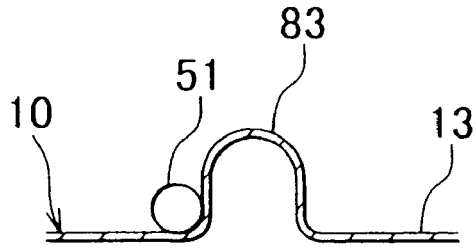
FIG. 10 illustrates the cross-sectional view of a nozzle guide in another modified example of the embodiment.
Figure 11:
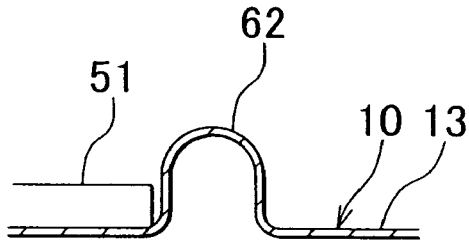
FIG. 11 illustrates the cross-sectional view of a stopper in another modified example of the embodiment.
Figure 12:
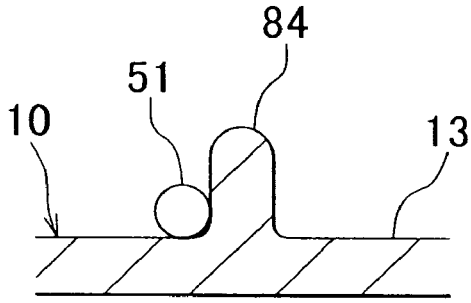
FIG. 12 illustrates the cross-sectional view of a nozzle guide in another modified example of the embodiment.
Figure 13:
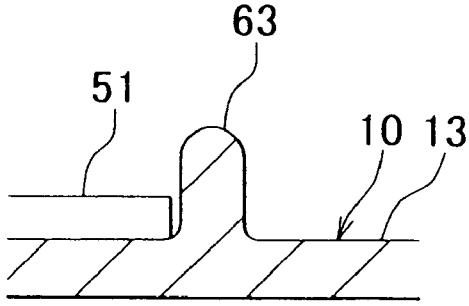
FIG. 13 illustrates the cross-sectional view of a stopper in another modified example of the embodiment.
Figure 14:
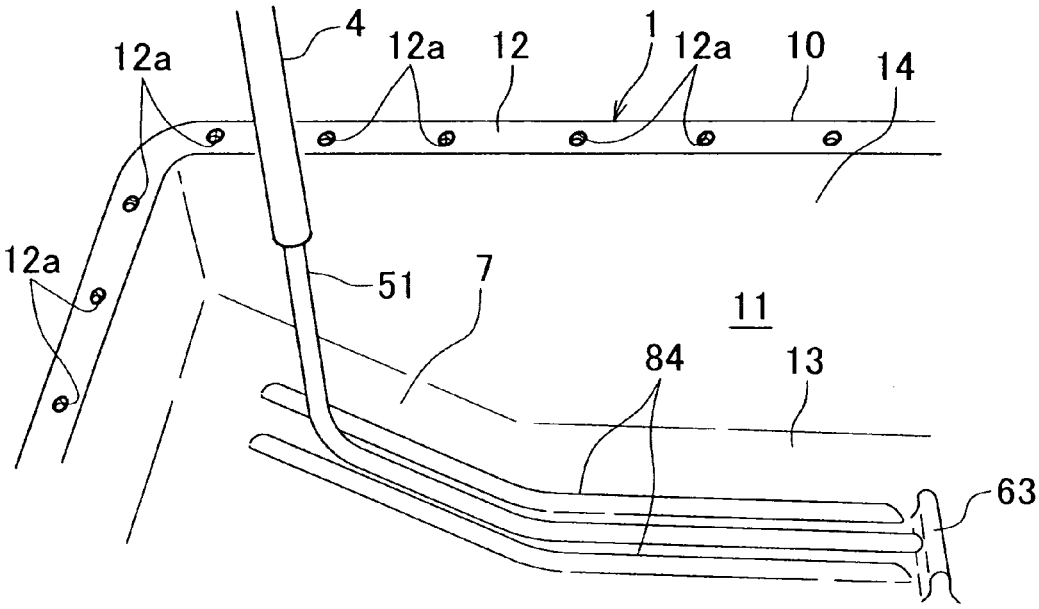
FIG. 14 illustrates the perspective view of a rear portion of an oil pan body in another modified example of the embodiment.
Figure 15:
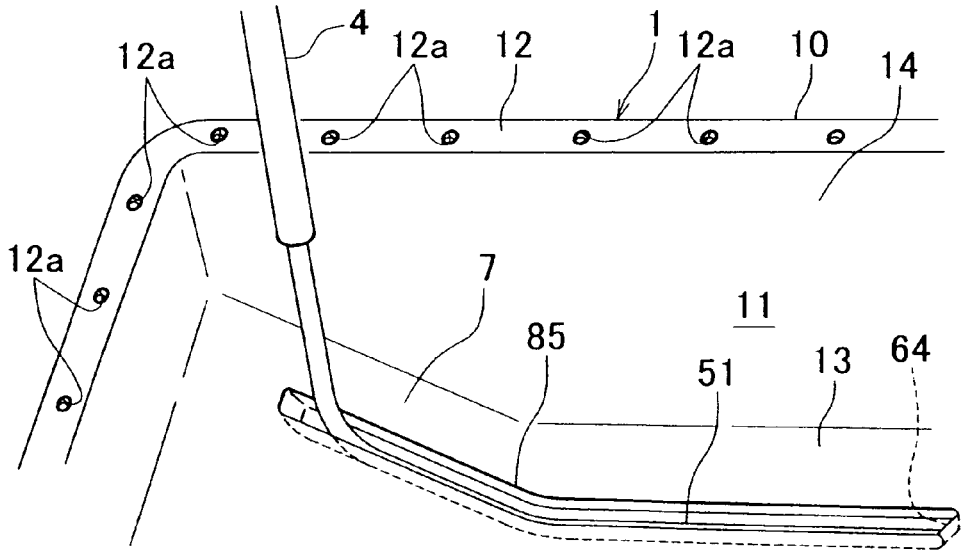
FIG. 15 illustrates the perspective view of a rear portion of an oil pan body in another modified example of the embodiment.
Figure 16:
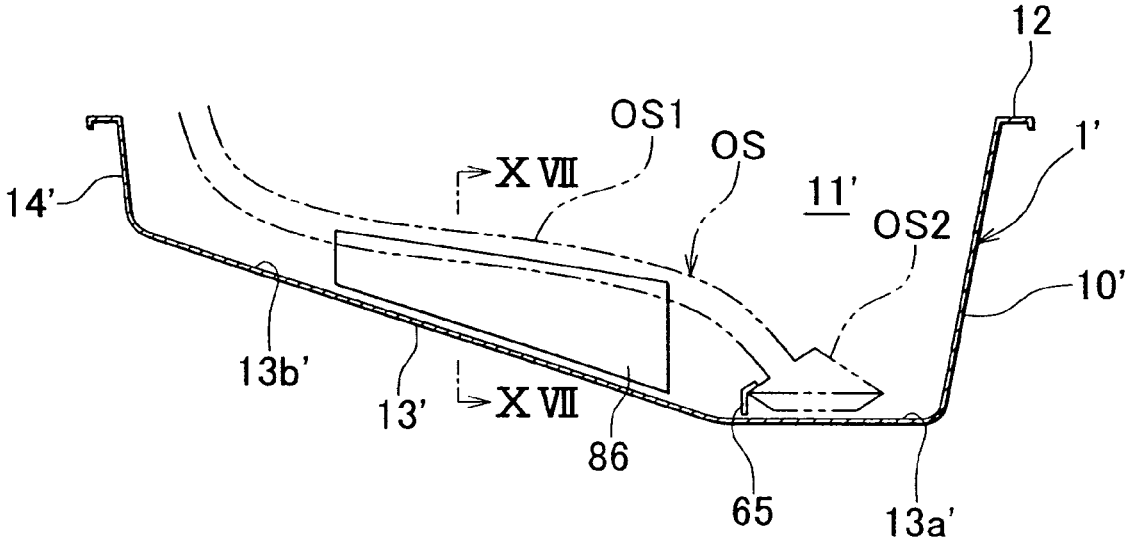
FIG. 16 illustrates the cross-sectional view of an oil pan in another modified example of the embodiment.
Figure 17:
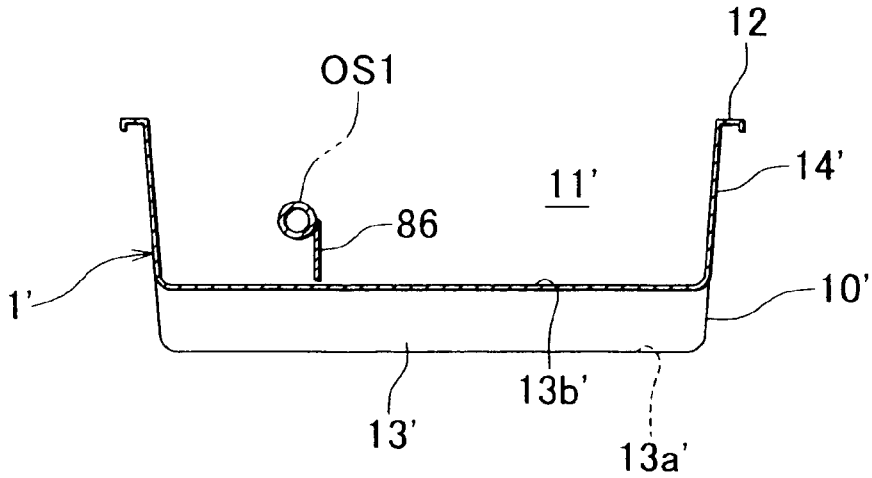
FIG. 17 illustrates the cross-sectional view of the oil pan taken along line XVII-XVII in FIG. 16.
Figure 18:
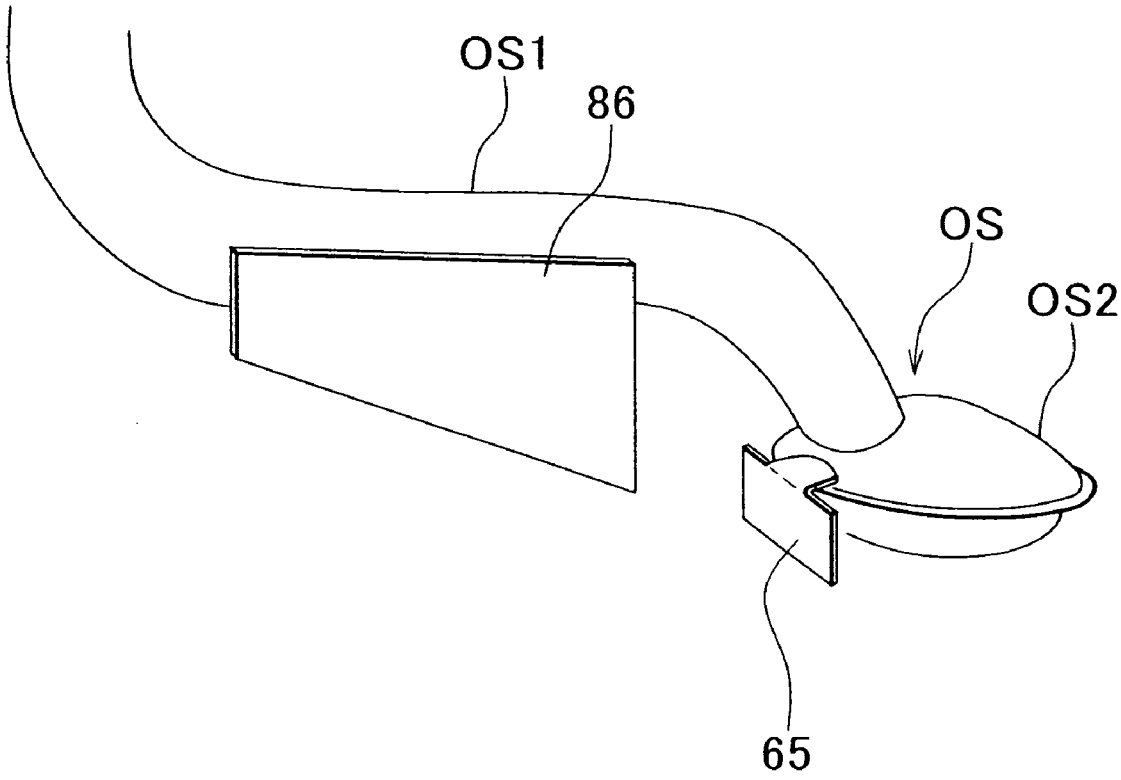
FIG. 18 illustrates the perspective view of an oil strainer provided with a nozzle guide and a stopper.

In the above-mentioned embodiment, the second frothing-suppression plate 16 (nozzle guide) having the substantially L-shaped cross-section, which also serves as the nozzle guide, and the stopper 61 are formed separately from the oil pan body 10. However, as shown in FIGS. 10 and 11, a nozzle guide 83 and a stopper 62 may be formed integrally with the bottom-wall portion 13 of the oil pan body 10 by press forming. Ribs formed at the appropriate location in the bottom-wall portion 13 can be used as the nozzle guide 83 and the stopper 62. In this case, the nozzle guide 83 and the stopper 62 are formed by press forming. Accordingly, the oil pan 1 can be easily formed without increasing the number of the components. Alternatively, as shown in FIGS. 12 and 13, the oil pan body 10 may be made of aluminum alloy and formed by die-casting. Each of a nozzle guide 84 and a stopper 63 may be formed integrally with the oil pan body 10, and protrude from the bottom-wall portion 13 of the oil pan body 10 to form a rib. In this case, the nozzle guide 84 and the stopper 63 are formed by die-casting, and the oil pan 1 can be easily formed without increasing the number of components. Also, as shown in FIG. 14, along with the guide portion 7 and the stopper 63, the two nozzle guides 84, 84 may be formed integrally with the bottom-wall portion 13 of the oil pan body 10 by using the die made of aluminum alloy. These two nozzle guides 84, 84 extend in parallel with each other on the bottom-wall portion 13 of the oil pan body 10 from the guide portion 7 toward the position near the deepest portion of the reservoir portion 11. Then, the front end of the nozzle 51 of the oil changer 5 may be guided to the stopper 63 while the nozzle 51 is sandwiched between the nozzle guides 84, 84. Alternatively, as shown in FIG. 15, when the oil pan body 10 is formed by pressing a steel plate into the appropriate shape or formed of aluminum alloy by die-casting, a nozzle guide 85 may be integrally formed as a groove in the bottom-wall portion 13. The nozzle guide 85 extends in the bottom-wall portion 13 of the oil pan body 10 from the guide portion 7 to the position near the deepest portion of the reservoir portion 11. In this case, the end of the nozzle guide 85 close to the deepest portion serves as a stopper 64. Accordingly, the nozzle guide 85 and the stopper 64 can be easily formed regardless of whether they are produced by press forming or die-casting. Thus, the oil pan 1 can be formed easily without increasing the number of components. Also, as shown in FIGS. 16 to 18, in an oil pan 1' in which a forward portion 13*a*' of a bottom-wall portion 13' becomes the deepest portion when an oil pan body 10' is attached to the cylinder-block-lower-case, the upper end side of a substantially trapezial nozzle guide 86 may be attached to an intake tube OS1 of the oil strainer OS. The oil strainer OS extends above a rear portion 13*b*' which tilts from a side-wall portion 14' toward a forward portion 13*a*' in a reservoir portion 11'. In this case, the lower end side of the nozzle guide 86 extends along the rear portion 13*b*' while a predetermined distance is maintained between the nozzle guide 86 and the rear portion 13*b*'. In addition, the upper end of a vertical-wall-shaped stopper 65 may be fitted to an intake portion OS2 of the oil strainer OS. In this case, the lower end of the stopper 65 is provided while a predetermined distance is maintained between the stopper 65 and the forward portion 13*a*'. The direction in which the vertical-wall-shaped stopper 65 extends is perpendicular to the direction in which the nozzle guide 86 extends. In this structure, the nozzle guide 86 and the stopper 65 need not be provided integrally with the oil pan body 10'. Accordingly, the effects of the invention can be easily achieved by using the commonly-used oil pan 1'.

In the above-mentioned embodiment, the oil pan body 10 formed by pressing a metal plate into the appropriate shape or formed of aluminum alloy by die-casting is used. However, the oil pan body made of magnesium alloy or a resin material may be used.

What is claimed is:

1. An oil pan structure, comprising:

an oil pan with a reservoir portion in which oil is stored;

a tubular member that provides communication between the reservoir portion and an outside of the oil pan, and is arranged such that one end of the tubular member opens into the reservoir portion;

a nozzle guide that guides an end of a nozzle of an oil changer, which is inserted into the tubular member and which replaces oil in the reservoir portion with new oil, to a position near a deepest portion of the reservoir portion; and a guide portion that guides the end of the nozzle of the oil changer, which has been guided into the reservoir portion, to the nozzle guide, wherein the guide portion is provided above a position at which a bottom surface of the oil pan intersects with a virtual guide line that corresponds to a path that the nozzle of the oil changer would continue along after being inserted in the tubular member and guided into the reservoir portion in an absence of any obstructions in the path; and the nozzle guide is provided on a top side of a bottom portion of the oil pan.

2. The oil pan structure according to claim 1, wherein the tubular member is a level-gauge guide into which an oil level-gauge that measures an amount of oil remaining in the reservoir portion is inserted.

3. The oil pan structure according to claim 1, further comprising:

a stopper that sets the end of the nozzle of the oil changer, which has been guided to the position near the deepest portion of the reservoir portion, at the position near the deepest portion of the reservoir portion.

4. The oil pan structure according to claim 3, wherein the stopper is formed separately from an oil pan body, and is attached to the oil pan body.

5. The oil pan structure according to claim 3, wherein the stopper is formed integrally as a rib within an oil pan body.

6. The oil pan structure according to claim 1, wherein the nozzle guide is formed separately from an oil pan body, and attached to the oil pan body.

7. The oil pan structure according to claim 1, wherein the nozzle guide is formed integrally as a rib within an oil pan body.

8. The oil pan structure according to claim 1, wherein the nozzle guide is formed integrally as a groove within an oil pan body.

* * * * *